US005802969A

United States Patent [19]

Wess et al.

[11] Patent Number: 5,802,969

[45] Date of Patent: Sep. 8, 1998

[54] METHOD AND APPARATUS FOR TRANSFERRING IMAGES ONTO A CUP-SHAPED STRUCTURE

[75] Inventors: Raymond E. Wess, Holley; Carlos F. Rezende, Rochester; Daniel C. Davis, Rush, all of N.Y.

[73] Assignee: Eastman Kodak Company, Rochester, N.Y.

[21] Appl. No.: 843,686

[22] Filed: Apr. 10, 1997

[51] Int. Cl.[6] ..... B41F 17/20

[52] U.S. Cl. ..... 101/9; 101/32; 156/240; 156/583.1

[58] Field of Search ..... 101/31, 32, 33, 101/34, 35, 38.1, 39, 40, 9, 488, 41; 8/471, 472, 473; 156/DIG. 41, 499, 240, 583.1; 219/243, 521, 535, 546, 547, 548, 549, 552

[56] References Cited

U.S. PATENT DOCUMENTS

| | | | |
|---|---|---|---|
| 1,076,858 | 10/1913 | Andrews . | |
| 1,841,332 | 1/1932 | Kranz . | |
| 2,298,315 | 10/1942 | Siegel et al. . | |
| 2,965,868 | 12/1960 | Eichler . | |
| 4,658,721 | 4/1987 | Mathis | 101/32 |
| 4,874,454 | 10/1989 | Talalay et al. . | |
| 4,943,684 | 7/1990 | Kramer . | |
| 4,989,508 | 2/1991 | King . | |
| 5,019,193 | 5/1991 | Aramini . | |
| 5,170,704 | 12/1992 | Warren et al. | 101/41 |
| 5,244,529 | 9/1993 | Siegel . | |
| 5,296,081 | 3/1994 | Morin et al. . | |
| 5,382,313 | 1/1995 | Eminger | 156/583.1 |
| 5,584,961 | 12/1996 | Ellsworth et al. | 156/481 |
| 5,643,387 | 7/1997 | Berghauser et al. | 8/471 |
| 5,711,837 | 1/1998 | Kantrowitz | 156/240 |

*Primary Examiner*—Ren Yan

*Attorney, Agent, or Firm*—Frank Pincelli; David A. Novais

[57] ABSTRACT

A method and apparatus for imprinting a sublimation transfer onto a generally cup-shaped structure. The apparatus comprises a support structure for holding the cup-shaped structure and a cover mounted to the apparatus for movement between an open position and a closed position. The cover when in the closed position forms a heating chamber wherein the cup-shaped structure is positioned for heating. A heating tower is provided on the support structure and has a shape such that the cup-shaped structure can be placed in the inverted position over the tower without touching the tower. The heating tower includes an electrical heating wire that is wrapped about a support structure and is capable of heating the cup-shaped structure.

23 Claims, 6 Drawing Sheets

METHOD AND APPARATUS FOR TRANSFERRING IMAGES ONTO A CUP-SHAPED STRUCTURE

FIELD OF THE INVENTION

The present invention relates to a method and apparatus for transferring images onto a cup-shaped structure, more specifically, a method and apparatus for transferring dye sublimation ink transfers onto cups, mugs, and other similar cup-shaped structures, hereinafter collectively called mugs.

BACKGROUND OF THE INVENTION

The printing of sublimation transfers onto a mug by heating is well known. The printing process involves the transferring of an image on the sublimation transfer by heat and contact pressure. There are many types of sublimation transfers that can be imprinted by various printing devices, for example, copy machines, laser printers, printing presses, etc. The key to all these image transfers is that they all use a form of "sublimation" ink. The sublimation transfer is made up of two basic parts: the transfer release paper, and sublimation dyes. The sublimation dyes are printed onto the transfer release paper. The heat transfer process heats the transfer paper and sublimation dye to a predetermined temperature. As the temperature of the mug rises during the heating cycle time, the sublimation dyes start to transfer from the transfer paper to the mug. The transmissiveness of sublimation dyes from the transfer paper to the mug is the key to any heat transfer process. Different types of sublimation transfers transfer at different operating temperatures. However, the primary requirement for obtaining a good image transfer is the uniform heating of the mug. If there are "cold spots" around the mug, due to non-uniform heating, undesirable non-uniform transfer of the dye onto the mug will occur resulting in a low quality product.

There are various known techniques for heating a mug and image transfer for transferring the image to the mug. For example, U.S. Pat. No. 5,019,193 describes a mug press with a heated blanket. U.S. Pat. No. 4,989,508 describes a method for clamping a transfer onto a mug which is heated by hot air conduction. U.S. Pat. No. 4,874,454 describes a flexible transfer head with a flexible heating element. U.S. Pat. No. 5,244,529 describes a clamp and mug transfer system where heat is applied to the mug by an electric heating blanket. A problem associated with heating blankets are that they are expensive and have a short life. In addition, it is difficult to construct a reliable blanket that provides uniform pressure and heat. Other prior art types of heating systems tend to provide non-uniform heating.

The present invention provides a unique method and apparatus that provides uniform heating of the mug, which results in excellent transfer of images, while maintaining high reliability and long life.

SUMMARY OF THE INVENTION

In accordance with one aspect of the present invention there is provided an apparatus for imprinting a sublimation transfer onto a generally cup-shaped structure. The apparatus comprises a support structure for holding the cup-shaped structure and a cover mounted to the apparatus for movement between an open position and a closed position. The cover, when in the closed position, forms a heating chamber wherein the cup-shaped structure is positioned for heating. A heating tower is provided on the support structure and has a shape such that the cup-shaped structure can be placed in the inverted position over the tower without touching the tower. The heating tower includes an electrical heating wire that is wrapped about a support structure and is capable of heating the cup-shaped structure.

In accordance with another aspect of the present invention, there is provided a method of imprinting sublimation dye transfers onto a generally cup-shaped structure. The method comprising the steps of:

a) providing a support for supporting the cup in the inverted position;

b) providing a cover that can move between an open position and closed position, the cover in the closed position providing a heating chamber in which the cup-shaped structure can be placed in the inverted position;

c) providing a heating tower for positioning within the inverted cup-shaped structure;

d) placing a cup-shaped structure on the support in the inverted position over the heating tower; and e) energizing the heater tower when the cover is placed in the closed position and the cup is positioned on the support.

BRIEF DESCRIPTION OF THE DRAWINGS

Other objects, advantages and features of the present invention will become apparent from the following specifications when taken in conjunction with the drawings in which like elements are commonly enumerated and in which.

DETAILED DESCRIPTION OF THE INVENTION

Figure 1:
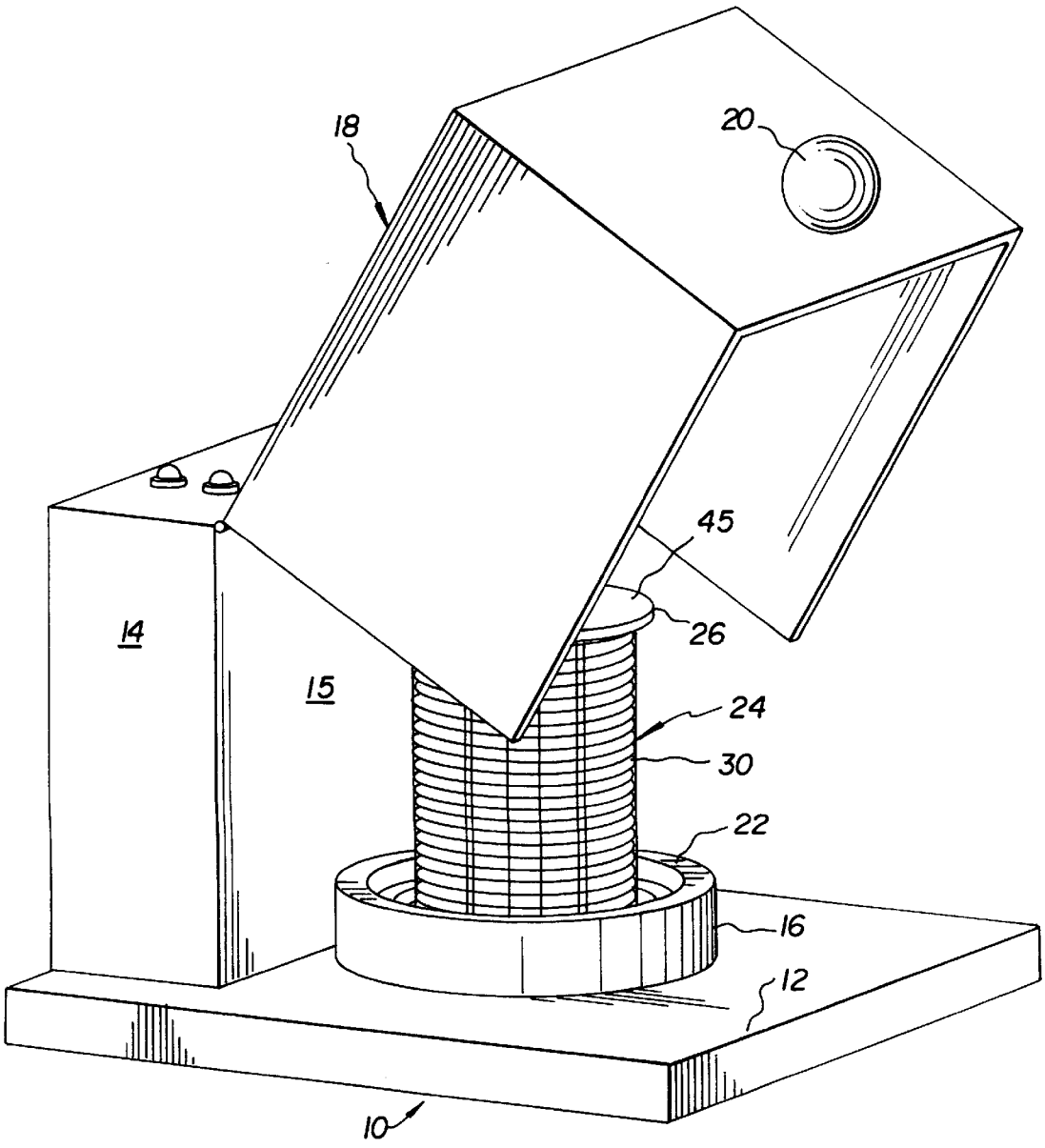
FIG. 1 is a perspective view of an apparatus made in accordance with the present invention illustrating the cover in the open position.
Figure 2:
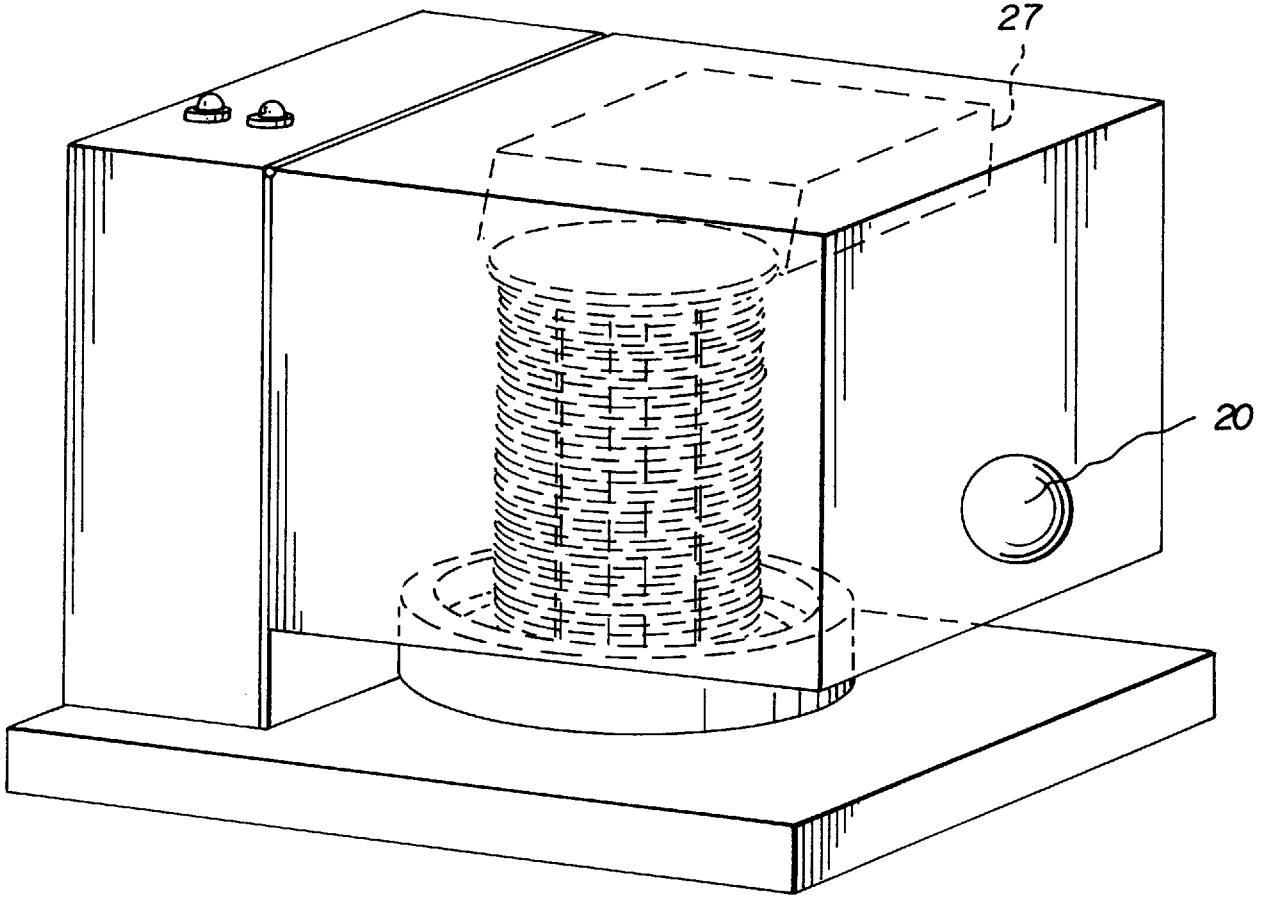
FIG. 2 is a perspective view of the apparatus of FIG. 1 illustrating the cover in the closed position.
Figure 3:
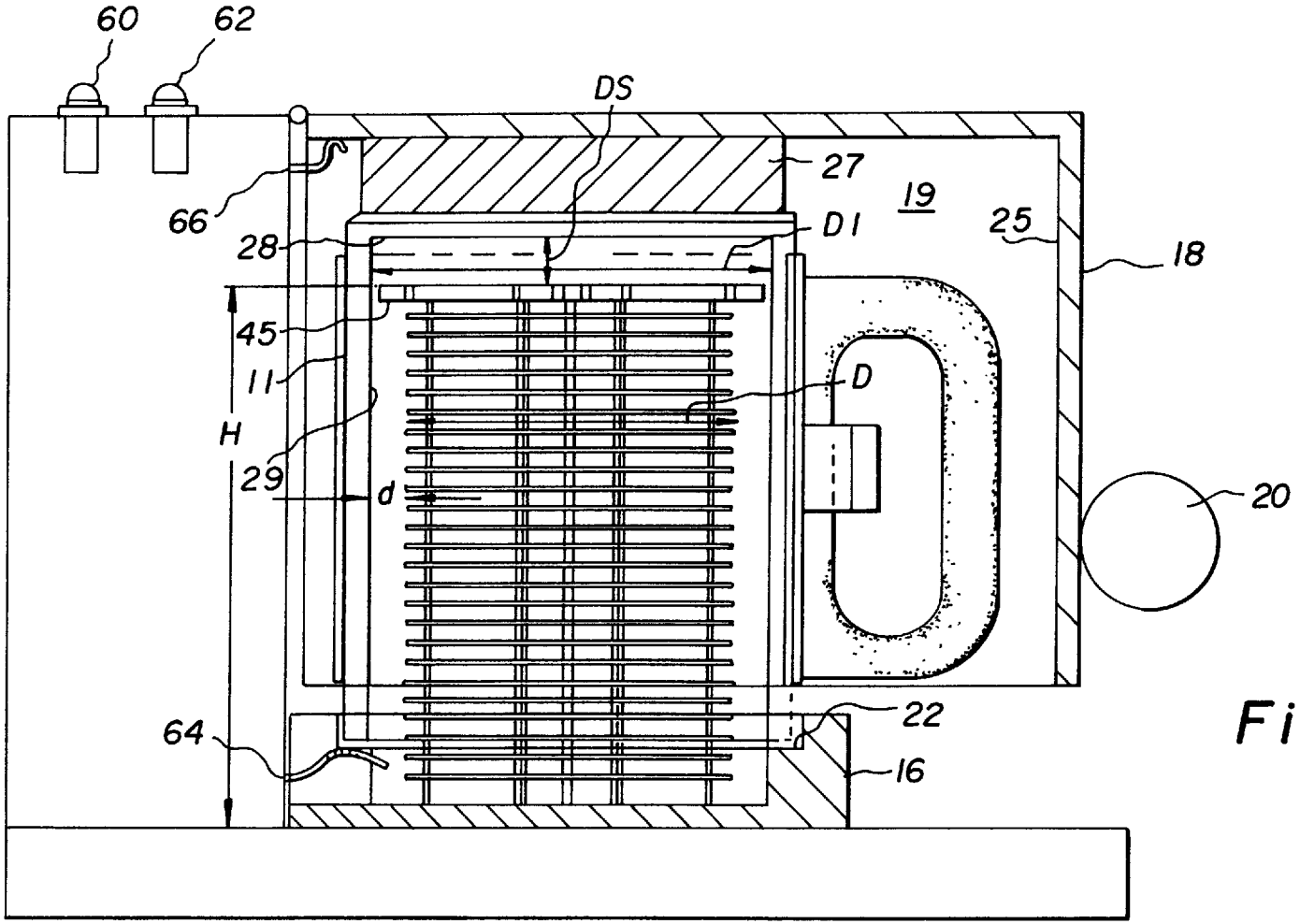
FIG. 3 is a cross-sectional view of the apparatus of FIG. 2 as taken along line 3—3 illustrating a mug positioned therein for heating.

Referring to FIGS. 1, 2 and 3, there is illustrated an apparatus 10 made in accordance with the present invention for transferring images from a sublimation dye transfer to a mug 11, or other similar type cup-shaped structures. The apparatus 10 includes a base 12 and a vertical support tower 14 disposed on base 12. The base 12 includes a mug annular support ring 16 which is disposed adjacent to the vertical wall 15 of vertical support tower 14 such that a cover 18 secured to support tower 14 can move between an open position, as illustrated in FIG. 1, to a closed position, as illustrated in FIG. 2. The cover 18, when in the closed position, in combination with the base 12 and vertical wall 15, provides a substantially closed chamber 19 around the support ring 16 and any mug placed thereon. Cover 18 includes a handle 20 for moving the cover member 18 between the open and closed positions. The mug support ring 16 has an upper support surface 22 and is configured so as to mate and support the rim 23 of a mug 11 placed in the inverted position thereon. The inside surface 25 of cover 18 is provided with a insulation pad 27 which is positioned on cover 18 and is sized such that pad 27 will engage the bottom of mug 11 and substantially cover the entire mug bottom. This assists in maintaining uniform heat along the surface of the mug where the image is to be transferred. Pad 27 may be made of any appropriate insulating material. In the embodiment illustrated, pad 27 is made of a silicone rubber that is readily available in the market.

Concentricity located within support ring 16, there is provided an electric heating tower 24. The height H of tower 24 is such that the top 26 is positioned a short distance DS below the bottom surface 28 of a mug 11 placed on support ring 16 (see FIG. 3). In the preferred embodiment, the tower 24 has a substantially circular cross-section having a diameter D less than the inside diameter D1 of the mug 11, such that the periphery of the tower 24 is spaced a distance d from the inside wall 29 of the mug 11. In the particular embodiment illustrated, tower 24 has a diameter D of about 2.25 inches for use with a mug 11 having an inside diameter D1 of approximately 2.75 inches, resulting in distance d being about 0.25 inches.

Figure 4:
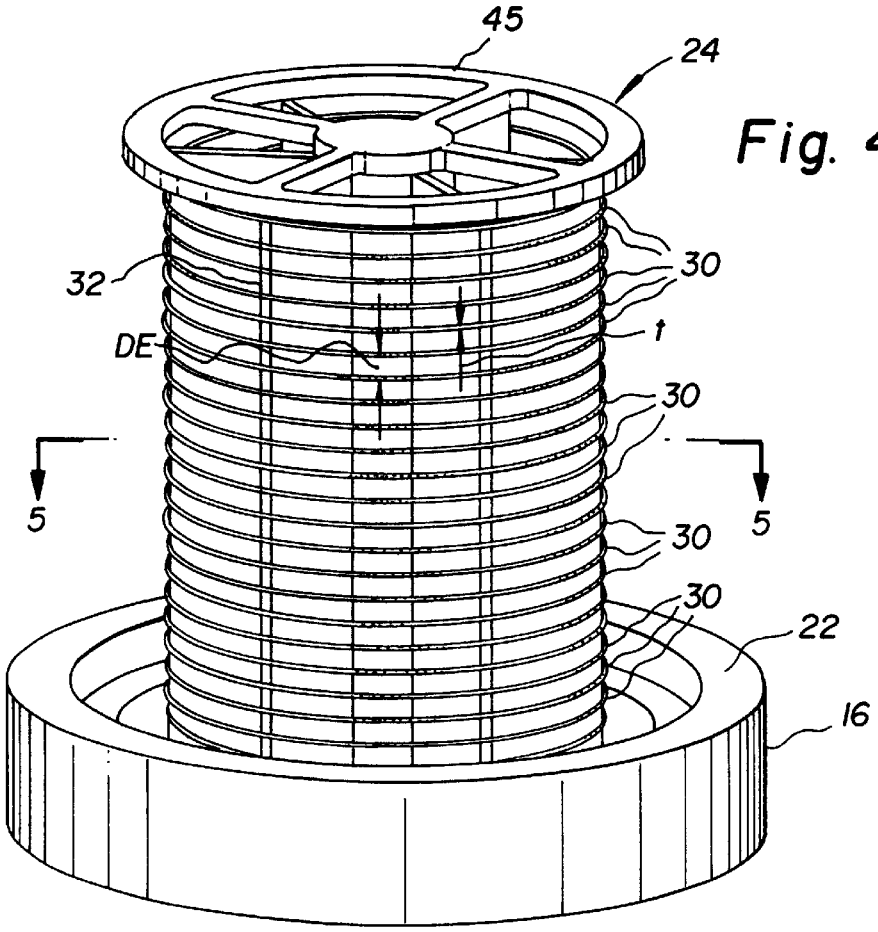
FIG. 4 is an enlarged elevational view of the heating tower of the apparatus of FIG. 1.

Referring to FIG. 4, there is illustrated an enlarged view of tower 24 and support ring 16. In the embodiment illustrated, the tower 24 comprises a heating element 30, for example, nickel-chromium wire, which is spirally wrapped about a support structure 32. Adjacent spiral wraps are spaced a distance DE apart, such that a substantial uniform heat is provided. In the embodiment illustrated, the element 30 comprises a nickel-chromium wire having a diameter of about 0.015 inches (AWG 26) and has a resistance of 2.571 ohms/ft. The distance DE between adjacent wraps is about 0.125 inches (3.175 mm). The ends of the heating element 30 are appropriately connected to an electrical supply, such that when an electrical current is applied thereto, the heating element 30 will heat up so as to provide heat to the interior of mug 11 at the desired temperature. In the particular embodiment illustrated, the heating element 30 heats the mug 11 such that the outside surface of the mug 11 reaches a temperature range from about 250° F. to 350° F. However, it is to be understood that the temperature may be controlled to meet the requirements of the sublimation dyes being transferred.

Figure 5:
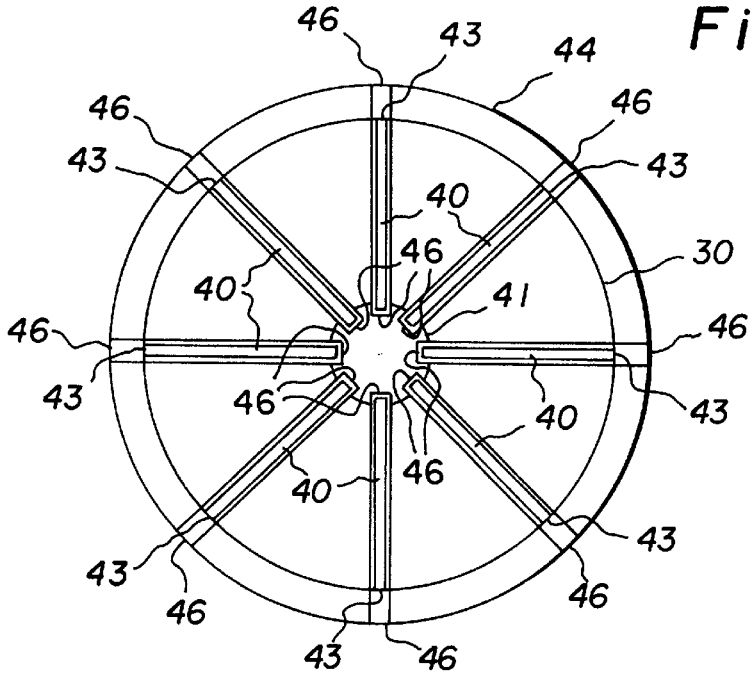
FIG. 5 is a cross-sectional view of the heating tower of FIG. 4 as taken along line 5—5 of FIG. 4.

Referring to FIG. 5, there is illustrated a cross-sectional view of the heater tower 24 as taken along line 5—5 of FIG. 4. In the embodiment illustrated, the support structure 32 comprises a plurality of quartz glass members 40 disposed about a central hub 41. It is also understood that members 40 could be any high temperature non-electrically conductive material. The members 40 each comprise a plate member having an outer support surface 43 about which the element 30 is spirally wrapped. An end plate 44 and a hub 41 are provided for mounting of members 40. In the particular embodiment illustrated, grooves 46 are provided in the end plate 44 and hub 41 for receiving members 40. A cap 45 (see FIG. 4) is provided for guiding the mug 11 as it is placed on support ring 16. The cap 45 has an outer annular projecting ring which extends radially beyond the heating element 30.

Figure 6:
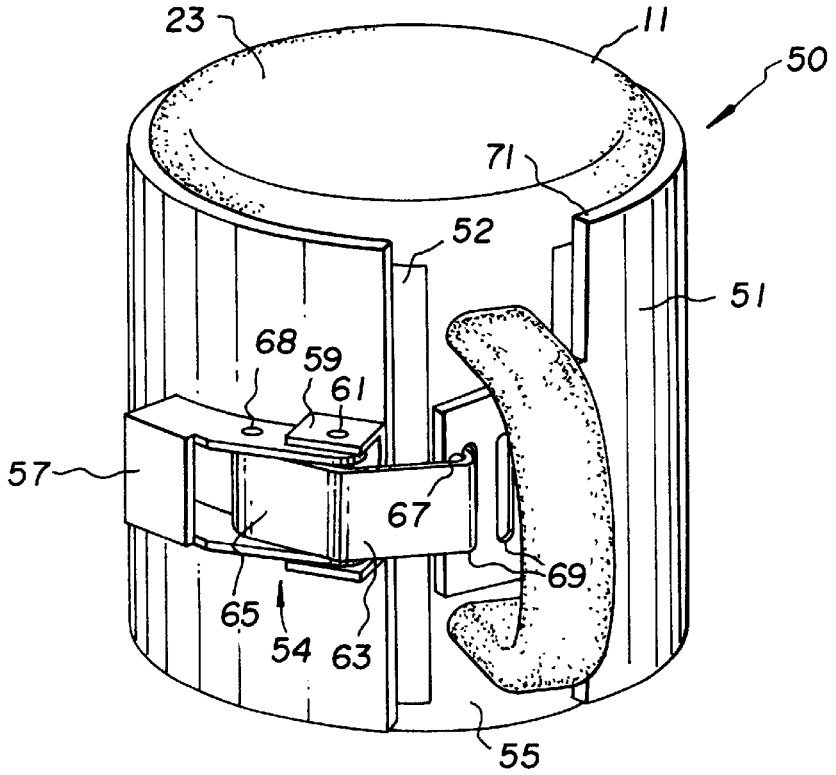
FIG. 6 is a perspective view of a clamp for use with the apparatus of FIG. 1 for clamping a sublimation dye transfer against a mug.
Figure 7:
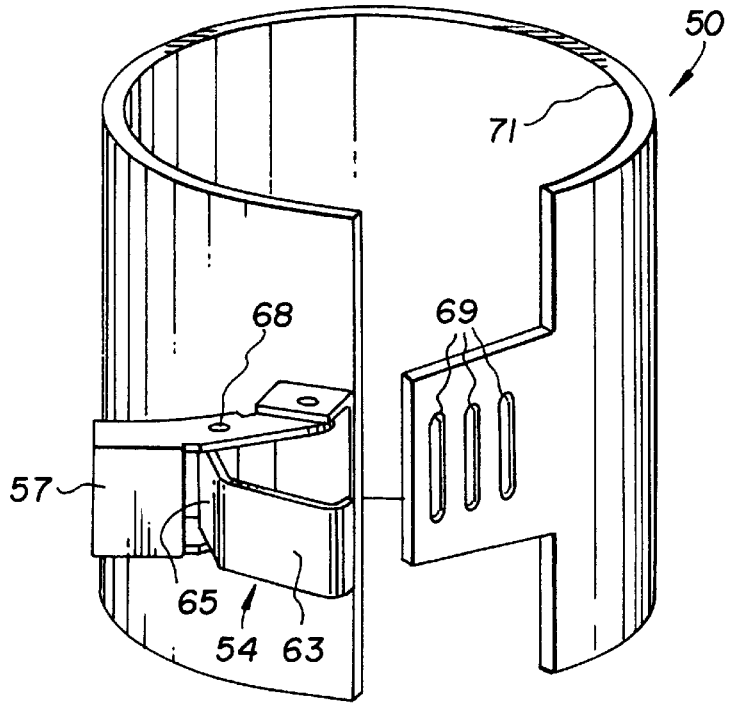
FIG. 7 is a perspective view similar to FIG. 6 illustrating the clamp of FIG. 6 in the unclamped position.

Referring to FIGS. 6 and 7, there is illustrated a clamp 50 which is designed to be used with mug 11. A suitable clamp may be purchased from Fargo Electronics, Eden Paririe, Minn. In particular, the clamp 50 is designed to securely hold in place a sublimation dye transfer 52 during the heating process, such that the sublimation dyes from the transfer 52 will be transferred onto the mug 11. The sublimation dye transfer 52 may be any type as is commonly known and utilized for such purpose. FIG. 7 illustrates the clamp 50 in the unengaged open position for receiving a mug and transfer, and FIG. 6 illustrates the clamp in the closed position about a mug 11 with a transfer 52 clamped therebetween.

The clamp 50 is preferably made of a material such that the clamp 50 will not be adversely affected by the heat to which it is to be subjected. In the embodiment illustrated, the clamp 50 is made of thin sheet metal, for example, steel or aluminum. The clamp 50 is designed with an over-the-center mechanism 54 so that the clamp can be secured and/or released from engagement with the cup and transfer 52. The clamp 50 comprises a flexible shell C-shaped member 51 having a smooth inner surface lined with silicone rubber 53 designed to engage the outer surface 55 of mug 11. In the embodiment illustrated, the over-the-center mechanism is disposed at one end of the C-shaped member 51 and comprises a lever 57 pivotably mounted to mount member 59 at one end 61. A clasp member 63 is provided having one end 65 pivotably mounted to lever 57 at a point 68 spaced from end 61 and a hook member 67 at the other end. The hook member 67 is designed to engage any one of the openings 69 provided in the other end of member 51. When the over-the-center mechanism 50 is in the position illustrated in FIG. 7, a sublimation dye transfer 52 having an image to be transferred thereon, can be easily inserted in position between the clamp 50 and mug 11, and once properly positioned, the clamp 50 is secured by moving the over-the-center mechanism 54 to the position illustrated in FIGS. 3 and 6. When the over-the-center mechanism 54 of the clamp 50 is in the clamping position as illustrated in FIGS. 3 and 6, a clamping force is applied against the mug 11, thereby clamping the sublimation dye transfer 52 placed between the clamp 50 and mug 11. The clamp 50 includes a insulating layer 71 for minimizing the temperature of the outside surface of the clamp 50, and to provide uniform pressure between mug 11 and transfer 52.

It is to be understood that any appropriate clamping mechanism can be used so long as a sufficient degree of pressure is applied against the transfer to maintain the transfer in intimate and direct contact with the mug 11 so that the heat being passed internally from the inside of the cup to the outside of the cup will pass directly to the clamp.

Figure 8:
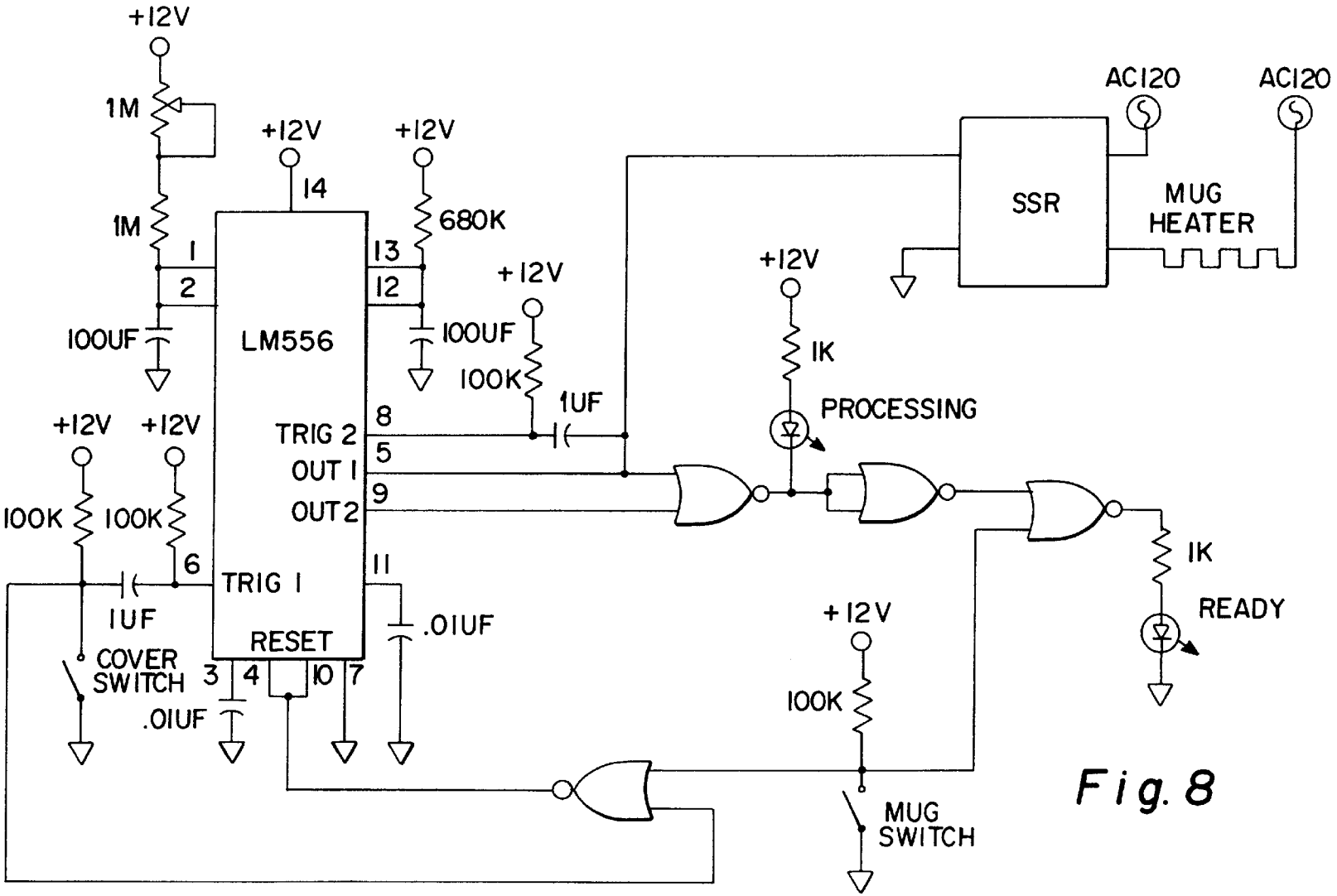
FIG. 8 is an electrical schematic view of an electrical circuit for use in controlling the apparatus of FIG. 1.

Inside vertical support tower 14, there is provided appropriate electronic and mechanisms for the control and operation of the apparatus 10. FIG. 8 illustrates an electric circuit that can be used for controlling apparatus 10. However, any desired control circuit or system may be used to control the apparatus as is well know in the art. In the embodiment illustrated, lights 60,62 are provided for indicating the operational status of the apparatus 10. Interlock switches 64,66 are provided so as to protect the user. The interlock switches 64,66 are placed such that the heater tower 24 will not be energized unless both a mug 11 is present and positioned on the support ring 16, and the cover 18 is in the closed position as illustrated in FIG. 3. Light indicators 60,62 are provided for indicating when a mug is being heated and when the process has been completed, respectively. The process complete light indicator 62 is used to advise the operator that an image transferred onto the mug 11 has been completed, and that the mug 11 should be removed from the apparatus 10.

The electrical circuit illustrated in FIG. 8 is designed so that an electronic timer is activated when a mug 11 is placed over the heating tower 24 and the cover 18 is closed. The timer control enables a solid state relay which energizes heating element 30 and turns on the heating indicating light 60. When a predetermined time has passed, the heating element 30 is turned off, and the process complete light 62 is energized. The amount of time necessary to achieve high quality results will vary depending on various aspects of the mug, for example, size of the mug, and material from which the mug is made, etc. However, the appropriate time can be easily determined with a few initial trial runs. Appropriate control dials or selection switches (not shown) are provided for allowing the user to adjust the operating temperature and time for heating of the mug 11. Applicants have found that high quality results in transfer of the image can be obtained at approximately 150 seconds of heating time.

Use of a highly coiled electric heating element 30, as disclosed in the present invention, provides for even distribution over the interior of the surface of the mug. Since most mugs are made of ceramic, and ceramic is a good conductor of heat, the heat applied to the inside of the mug tends to normalize the temperature by conducting heat through the entire ceramic mass. The mug 11 is positioned on the support ring and substantially traps all the heat generated by the coils, thereby minimizing the waste of heat therethrough so as to provide relatively uniform heating. Also, the present invention does not require any preheating. The apparatus 10 of the present invention is also relatively low cost, in that it is of relatively simple structure, requiring low maintenance and is reliable. In the preferred embodiment, the inside surface of the cover 18 directly over the bottom of the mug 11 is insulated by silicone rubber member 27 so as to help retain heat within the mug.

In order to more fully understand the present invention, a brief description of its use will now be described. The operator takes a mug 11 and positions clamp 50 in the open position about mug 11. A transfer 52 is positioned between the clamp 50 and mug 11. The clamp 50 is then closed so as to clamp the transfer 52 against the mug 11. The mug 11 is placed in the inverted position on ring 16 and the cover 18 is closed. The apparatus 10 is activated by an appropriate switch (not shown) and the mug 11 is heated at the preset temperature for the preset time period. Light 60 is activated during operation to indicate that the apparatus is in the heating mode. After the heating cycle is completed, light 62 is activated and light 60 is turned off. The cover 18 may then be opened and the mug 11 with clamp 50 is removed. After an appropriate period of time, the clamp 50 and transfer 52 are removed leaving an image on the mug 11.

While the present invention has been described with particular reference for use with mugs, it is to be understood that other similar-type cup or tubular-shaped products can also be used with the apparatus according to the present invention.

The invention has been described in detail with particular reference to certain preferred embodiments thereof, but it will be understood that variations and modifications can be effected within the scope of the invention. The present invention being limited by the following claims.

| PARTS LIST | |
|---|---|
| 10 | apparatus |
| 11 | mug |
| 12 | base |
| 14 | vertical support tower |

-continued

| PARTS LIST | |
|---|---|
| 15 | vertical wall |
| 16 | annular support ring |
| 18 | cover |
| 19 | closed chamber |
| 20 | handle |
| 22 | support surface |
| 23 | rim |
| 24 | electric heating tower |
| 25 | inside surface |
| 26 | top |
| 27 | insulation pad |
| 28 | bottom surface |
| 29 | inside wall |
| 30 | heating element |
| 32 | support structure |
| 40 | quartz glass member |
| 41 | central hub |
| 43 | outer support surface |
| 44 | end plates |
| 45 | cap |
| 46 | grooves |
| 50 | clamp |
| 51 | C-shaped member |
| 52 | sublimation dye transfer |
| 53 | silicone rubber |
| 54 | over-the-center mechanism |
| 55 | outer surface |
| 57 | lever |
| 59 | mount member |
| 60,62 | lights |
| 61 | end |
| 63 | clasp member |
| 64,66 | interlock switches |
| 65 | end |
| 67 | hook member |
| 68 | point |
| 69 | opening |
| 71 | insulating layer |

What is claimed is:

1. An apparatus for imprinting a sublimation transfer onto a generally cup-shaped structure, said apparatus comprising:

a support member for holding said cup-shaped structure;

a cover mounted to said apparatus for movement between an open position and a closed position, said cover when in the closed position forming a heating chamber wherein said cup-shaped structure having a sublimation dye transfer thereon is placed for heating; and a heating tower provided on said support member and having a shape such that said cup-shaped structure can be placed in an inverted position over said tower without touching said tower, said heating tower comprising a support structure and an electrical heating wire that is wrapped about said support structure, said heating wire being capable of heating said cup-shaped structure with the sublimation dye transfer thereon to transfer sublimation dyes from the sublimation dye transfer to the cup-shaped structure.

2. An apparatus according to claim 1 further comprising control means for controlling an operation of said electrical heating wire and for preventing operation of said electrical heating wire when said cover is in the open position.

3. An apparatus according to claim 1 wherein indicating means are provided for indicating when the heating of the cup-shaped structure has been completed.

4. An apparatus according to claim 1 wherein said cover includes a layer of insulation material positioned for engagement with a bottom of the cup-shaped structure.

5. An apparatus according to claim 1 wherein said support structure comprises a plurality of insulating plate members disposed about a hub forming a substantially circular periphery about which said electrical heating wire is wrapped.

6. An apparatus according to claim 5 wherein said electrical heating wire has a diameter of about 0.015 inches.

7. An apparatus according to claim 6 wherein said electrical heating wire is made of nickel-chromium.

8. An apparatus according to claim 1 wherein said electrical heating wire is spirally wrapped such that adjacent wraps are spaced a distance DE apart of about 0.125 inches.

9. An apparatus according to claim 1 wherein said cover is pivotably mounted to said apparatus.

10. An apparatus according to claim 1 wherein said electrical heating wire is spirally wrapped about said support structure.

11. An apparatus according to claim 1 wherein said electrical heating wire is wrapped about said support structure in a generally cylindrical configuration.

12. An apparatus according to claim 1 wherein an annular support ring is provided for supporting said cup-shaped structure in the inverted position.

13. A method of imprinting sublimation transfers onto a generally cup-shaped structure, said cup-shaped structure having a cylindrical outer surface and an inner surface, the method comprising the steps of:

a) providing a support member for supporting said cup in an inverted position;

b) providing a cover that can move between an open position and a closed position, said cover in the closed position providing a heating chamber in which said cup-shaped structure can be placed in the inverted position;

c) providing a heating tower for positioning within said inverted cup-shaped structure;

d) placing a cup-shaped structure having a sublimation dye transfer thereon on said support member in the inverted position over said heating tower; and e) energizing said heating tower when said cover is placed in the closed position and the cup-shaped structure having the sublimation dye transfer thereon is positioned on said support member, so as to transfer sublimation dyes from said sublimation dye transfer to said cup-shaped structure.

14. An apparatus for imprinting a sublimation transfer onto a generally cup-shaped structure, said apparatus comprising:

a support member for holding a cup-shaped structure having a sublimation dye transfer thereon;

a vertical support structure;

a cover structure mounted to said vertical support structure for movement between an open position and a closed position; and a heating tower provided on said support member designed for placement on said support member and having a height H and a diameter D, where height H being such that the heating tower does not touch an inside surface of said cup-shaped structure when said cup-shaped structure is placed on said support member, said heating tower comprising a heating wire that is spirally wrapped in a generally cylindrical configuration.

15. An apparatus according to claim 14 further comprising control means for controlling an operation of said heating wire and for preventing operation of said heating wire when said cover is in the open position.

16. An apparatus according to claim 14 wherein indicating means are provided for indicating when the heating of the cup-shaped structure has been completed.

17. An apparatus according to claim 14 wherein said cover includes a layer of insulation material positioned for engagement with a bottom of said cup-shaped structure.

18. An apparatus according to claim 14 wherein said heating tower comprises a plurality of insulating plate members disposed about a hub forming a substantially circular periphery about which said heating wire is wrapped.

19. An apparatus according to claim 18 wherein said heating wire has a diameter of about 0.015 inches.

20. An apparatus according to claim 19 wherein said heating wire is made of nickel-chromium.

21. An apparatus according to claim 14 wherein said heating wire is spirally wrapped such that adjacent wraps are spaced a distance DE apart of about 0.125 inches.

22. An apparatus according to claim 14 wherein said cover is pivotably mounted to said vertical support structure.

23. An apparatus for imprinting a sublimation transfer onto a generally tubular structure, said apparatus comprising:

a support member for holding said tubular structure;

a cover mounted to said apparatus for movement between an open position and a closed position, said cover when in the closed position forming a heating chamber wherein said tubular structure having a sublimation dye transfer thereon is placed for heating; and a heating tower provided on said support member having a shape such that said tubular structure can be placed in an inverted position over said tower without touching said tower, said heating tower comprising a support structure and an electrical heating wire that is wrapped about said support structure, said heating wire capable of heating said tubular structure to transfer sublimation dyes from the sublimation dye transfer to the tubular structure.

* * * * *